United States Patent [19]

Mette

[11] 4,319,613

[45] Mar. 16, 1982

[54] VALVE ARRANGEMENT FOR FILLING CONTAINERS WITH GAS-CONTAINING LIQUID

[75] Inventor: Manfred Mette, Hamburg, Fed. Rep. of Germany

[73] Assignee: Ortmann & Herbst GmbH, Hamburg, Fed. Rep. of Germany

[21] Appl. No.: 201,322

[22] Filed: Oct. 27, 1980

Related U.S. Application Data

[63] Continuation of Ser. No. 2,185, Jan. 9, 1979, abandoned.

[30] Foreign Application Priority Data

Jan. 11, 1978 [DE] Fed. Rep. of Germany ..... 2800972

[51] Int. Cl.[3] ..... B65B 31/00

[52] U.S. Cl. ..... 141/39; 141/147; 141/284; 141/302

[58] Field of Search ..... 141/4–6, 141/37, 39, 40, 46, 48, 147, 181, 192, 198, 227, 228, 250, 266, 270, 284, 301, 302, 308, 392

[56] References Cited

U.S. PATENT DOCUMENTS

| | | | |
|---|---|---|---|
| 2,605,949 | 8/1952 | Stern | 141/39 |
| 3,209,794 | 10/1965 | Granier | 141/46 |
| 3,415,295 | 12/1968 | Wolf | 141/46 |
| 3,774,655 | 11/1973 | Trusselle | 141/46 |
| 3,799,219 | 3/1974 | Uth et al. | 141/39 |

*Primary Examiner*—Frederick R. Schmidt
*Attorney, Agent, or Firm*—Michael J. Striker

[57] ABSTRACT

The filling valve arrangement for carbonated beverages includes a head part and a lower part movable in two opposite vertical directions with respect to the head by means of a cylinder piston unit, the lower part enclosing a liquid controlling valve chamber with a valve member, the bottom of the lower part being provided with a liquid discharge passage supporting a sealing ring compressable by the cylinder piston unit against the rim of a container to be filled, and liquid inlet conduit arranged in lateral wall of the lower part to communicate with the liquid controlling valve chamber. An air return pipe is slidably supported by the filling valve the vertical position of which is controlled by a separate driving mechanism.

10 Claims, 1 Drawing Figure

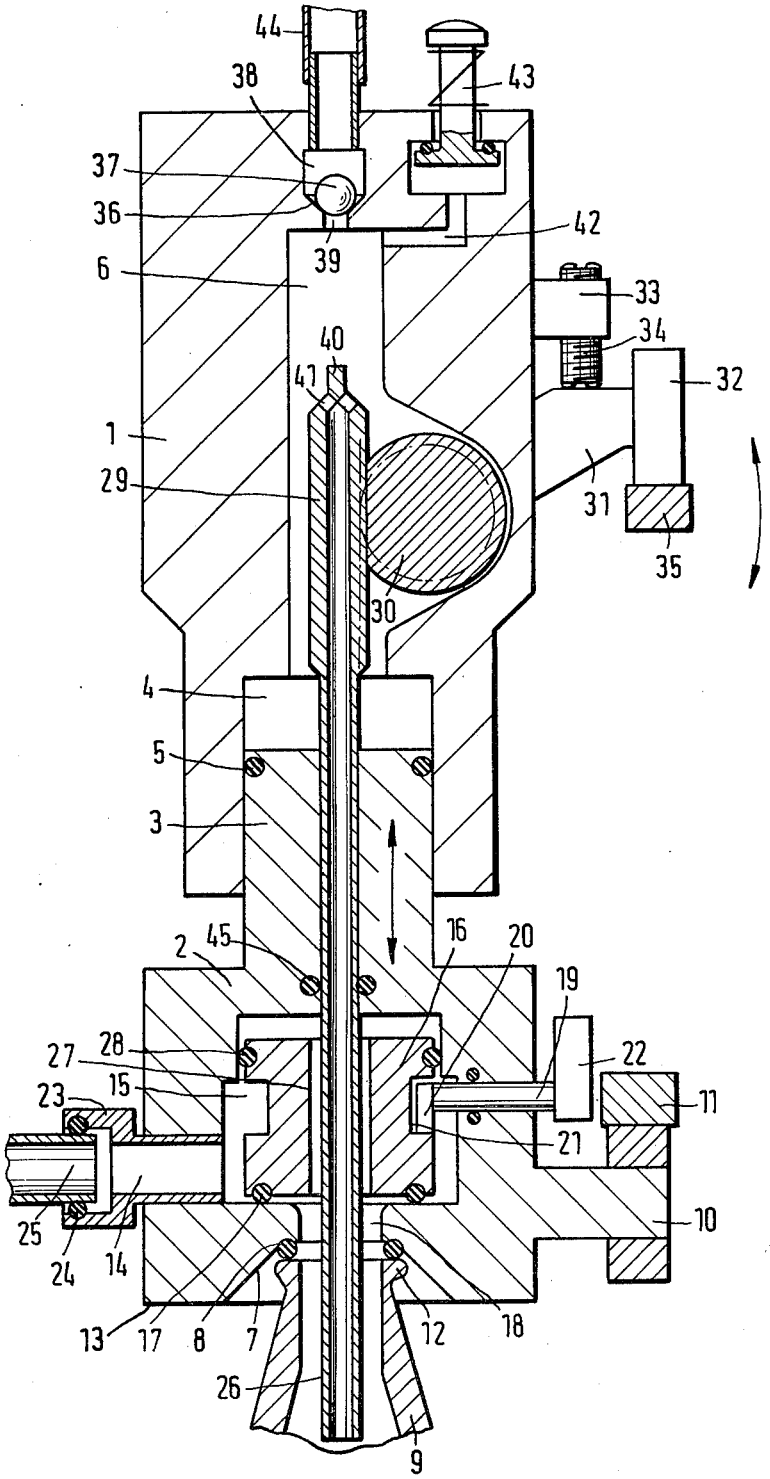
44
38
43
37
36
42
39
6
33
34
40
41
32
1
29
31
35
30
4
5
3
2
45
16
20
19
27
28
22
23
15
11
21
25
10
24
14
13
17
8
7
12
18
26
9

VALVE ARRANGEMENT FOR FILLING CONTAINERS WITH GAS-CONTAINING LIQUID

This is a continuation of application Ser. No. 002,185, filed Jan. 9, 1979, now abandoned.

BACKGROUND OF THE INVENTION

This invention relates generally to filling valve arrangement for containers and more specifically it relates to a filling valve for carbonated beverages including a cylinder piston pressing unit operable for compressing a sealing element against the rim of a container.

Filling valves of this type are known from German publication Nos. 20 31 589 and 20 42 990. In this known filling valve the part which carries the seal element for the container is supported for vertical movement on the lower end of the valve and driven relative to the latter by a cylinder-piston arrangement. The movable part according to the choice of design, may be constituted by the piston or alternatively by the cylinder of the cylinder-piston unit. The cylinder communicates with a source of pressurized gas so that in the course of an initial pressurizing process prior to the start of the filling process the sealing element is pressed, by the action of the pressurized gas against the rim of the container whereby the compressing force in optimum manner being dependent on the sealing pressure. The effective surface of the piston is designed such as to adjust the desired magnitude of the compressing force.

The disadvantage of this known construction is the fact that the cylinder piston unit is arranged at the lower part of the sealing valve in the range of a liquid controlling valve. As a consequence, the design possibilities are substantially limited. For instance, in both constructions disclosed in the afore-mentioned publications, the discharge passage between the liquid control valve and the lower edge of the filling valve has to be designed relatively long thus impeding the optimum conduction of the liquid and, as far as the maintenance of the constant filling level is concerned, these prior art constructions are disadvantageous. Moreover, the construction parts of the liquid controlling valve have to be accommodated in a limited space resulting in further disadvantages which impair the quality as well as the speed of the filling process.

SUMMARY OF THE INVENTION

It is, therefore, a general object of the present invention to overcome the aforementioned disadvantages.

More particularly, it is an object of the invention to provide an improved filling valve arrangement of the above-described type in which the liquid control valve, the liquid inlet conduit and the liquid outlet passage can be designed in optimum manner.

An additional object of the invention is to provide such an improved filling valve arrangement which enables to use long return air pipes at high filling speed.

A further object of the invention is to provide such an improved filling valve which makes it possible to eliminate hoses or bellows connections to the liquid feeding conduit.

In keeping with these objects, and others which will become apparent hereafter, one feature of the invention resides in a filling valve arrangement of the abovedescribed type, in which a cylinder piston unit connects a head with a lower part for guiding the lower part and pressing it on the container, the lower part having a valve chamber for accommodating the filling valve, which controlls a passage to a liquid inlet connection. In this novel construction the cylinder piston unit is not arranged between the sealing part of the filling valve and the remaining component parts thereof but it is arranged between the lower part of the filling valve which contains the liquid controlling valve and corresponding liquid conduits, and a head part. The liquid controlling valve, the liquid inlet conduit and the liquid outlet conduit can consequently be arranged in an optimum manner. This construction makes it, for the first time, possible to equip the filling valve arrangement of this type with a spatial spiral chamber as suggested in the German publication 26 20 753 and at the same time to maintain a short liquid discharging passage.

The filling valve arrangement of this invention can be designed without its own drive provided that a container lifting device is employed. The container lifting device is necessary, for example, in the case when the extra long downwardly projecting air return pipe is used. If, however, the filling valve such as used in can filling devices for example, is driven vertically in order to enable the exchange of cans in a horizontal plane only, so it is of advantage when the head part of the filling valve is stationary and the lower part is mechanically driven for a reciprocating vertical movement. This modification enables the reduction of moving mass about the rate of the cylindrical head.

It is also of particular advantage when the liquid inlet opening into the liquid controlling valve chamber is connected to a rigid liquid inlet pipe by means of an elastic seal. This arrangement enables a design in which the liquid inlet means communicate laterally with the valve chamber whereby the cylinder piston unit for the filling valve is located above the valve chamber so that the resulting construction is extraordinarily simple. The relatively long rigid connection pipe leading from a liquid storing tank to the filling valve is on both ends thereof connected to the inlet openings by means of elastic sealing rings only. The relatively short strokes of the lower part of the filling valve produce only relatively minute angular movements of the rigid connection pipe and these movements can be without difficulty intercepted by the elastic sealing rings. Consequently, any hose connections or bellows connections can be dispensed with.

Furthermore, the filling valve of this invention is with advantage provided with a separate reciprocating drive for the air return pipe extending from the mouth portion of the container through an axial passage in the cylinder piston unit and through the control member of the liquid controlling valve. This separate drive enables during the exchange of containers to lift the air return pipe which is relatively deeply introduced into the container, above the lower edge of the filling valve. The minute additional stroke of the filling valve can be thus performed in a perfect manner even if very high operating speeds are involved. With respect to the filling quality and the filling speed the latter combination is of extraordinary advantage.

In another modification of the filling valve of this invention, a separate reciprocating drive engages a portion of the air return pipe which projects above the liquid controlling valve. In this manner the liquid controlling system of the filling valve can be designed in any desired manner without taking regard to the driving arrangement for the air return pipe.

In a preferred embodiment, the separate reciprocating drive for the air return pipe includes a toothed rack arranged on the projecting portion of the air return pipe and a pinion engaging the rack and driven by external driving means. This arrangement facilitates the driving of the air return pipe via a constructionally simple rotary mechanism which can be more easily sealed.

In still another embodiment of the filling valve of this invention the air return pipe projects into the head part of the filling valve whereby the separate reciprocating drive is mounted on the head part. This arrangement insures a simple control of the separate reciprocating drive on a stationary head and also reduces inertial forces of the moving lower part of the cylinder piston unit about the mass of the air return pipe and its drive.

In a still further embodiment of this invention, the top portion of the air return pipe which projects into the head part terminates in an air return chamber provided in the head part. This chamber is provided with a pressure relief valve whereby the air return pipe is sealed with respect to the liquid controlling valve chamber in the lower part of the piston. In this embodiment the pressure relief valve is situated sufficiently far from the liquid controlling system of the filling valve so that during the pressure release no liquid can be carried along. In addition, in designing the liquid controlling system which according to this embodiment is situated in the lower part, the pressure relief valve need not be taken into account and consequently the whole construction is improved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE is an axial cross-section of a schematically illustrated embodiment of the filling valve arrangement according to this invention.

DESCRIPTION OF THE PREFERRED EMBODIMENTS

The illustrated filling valve arrangement is designed for operation in connection with a rotary filling machine in which a carbonated beverage such as beer, lemonade and the like is continuously filled into containers such as bottles or cans. According to the designed efficiency of the filling machine the latter may contain a plurality of such filling valve arrangements. In the drawing, the filling valve arrangement of this invention is illustrated in its filling position in contact with a bottle 9.

The filling valve includes two housing parts of which one in the illustrated example is made as a stationary cylindrical head 1 which is fixedly mounted to a non-illustrated rotary filling machine. The other part of the housing is a lower extension of a piston 3, the latter being axially movable in a cylindrical recess 4 of the cylindrical head 1. Piston 3 is sealed with respect to the cylindrical wall of recess 4 by means of sealing ring 5. A central portion of the top wall of cylindrical recess 4 communicates with an air return chamber 6 extending in axial direction in the cylindrical head 1.

The central portion of the bottom wall of the piston extension 2 has a conical recess 7 connected with filling sleeve 16 and supporting at its upper edge sealing element 8 in the form of a sealing ring which in the illustrated sealing position is compressed against rim 12 of bottle 9 positioned below the center of the filling sleeve 18 of the valve of this invention.

A cam follower 10 on the lateral wall of the piston extension 2 is directed reverse from the axis of rotation of the filling machine. During the rotation of the machine the follower 10 cooperates with a non-illustrated lifting cam and with a lowering cam 11 to move the piston extension 2 and thus the piston 3 through a predetermined stroke with respect to the stationary cylindrical head 1, the stroke being slightly larger than the overlap of the central conical recess 7 with respect to rim 12 of bottle 9. As it will be explained below, it is also necessary to lift during the displacement of bottle 9 the air return pipe 26 out of the bottle so that the bottle exchange can take place.

The shift or exchange of the container is effected as follows:

Upon the completion of the filling process, which took place in the illustrated position of the filling valve of this invention, air return pipe 26 is lifted, thereafter piston parts 2 and 3 are lifted by means of a non-illustrated lifting cam engaging the follower 10 to a level at which bottom wall 13 of piston extension 2 is above rim 12 of bottle 9. Whereupon bottle 9 without being moved in vertical direction is transported away in horizontal direction and replaced by an empty bottle. The new empty bottle is brought below the filling valve in a coarsely centered position. Subsequently, piston parts 2 and 3 are lowered by means of sinking cam 11 acting against projecting cam follower 10 or as the case may be the parts 2 and 3 sink by the effect of their own weight. During the sinking movement rim 12 of bottle 9 is finally centered by its engagement with the tapering surface of conical recess 7 and sealing element 8 abuts against the bottle rim 12.

The filling process starts with the introduction of pressurized gas into air return chamber 6 in the cylinder head 1 and thus into cylindrical recess 4. As a consequence piston 3 and piston extension 2 with sealing ring 8 are pressed against bottle rim 12 with a predetermined sealing force which preferably depends on the gas pressure in the sealed container. This compression force corresponds to the pressure of pressurized gas times the surface difference between the surface of piston 3 and the surface of bottle rim 12.

The processed liquid is fed into bottle 9 through lateral inlet channel 14 opening into valve chamber 15 provided in the piston extension 2. Valve chamber 15 contains a valve member 16 which is movable in two opposite vertical directions. In the lower position of valve member 16, the latter rests with its sealing ring 17 around the filling sleeve 18 in the bottom wall of valve chamber 15. Another sealing ring 28 arranged around the upper portion of valve member 16 separates together with the bottom sealing ring 17 the liquid inlet channel 14 from the liquid discharge sleeve 18, whereby the latter communicates through sealing ring 8 with the neck of bottle 9.

Valve member 16 is provided with a lateral recess 21 cooperating with a lifting and lowering mechanism consisting of a rotary shaft 19 passing through a lateral wall of piston extension 2 opposite the recess 21 of the valve member 16 and being provided at the inner end thereof with cam 20 cooperating with the recess 21 for lifting and lowering the valve member 16. For this purpose, the outer end of shaft 19 is connected to cam follower 22 which is operated by means of non-illustrated lifting and lowering cams which during the rotation of the filling machine control the cam follower 22 and thus the inner cam 20 in such a manner that valve member 16 is lifted about a small distance above the bottom of valve chamber 15 to open the connection between the liquid inlet passage 14 and the discharge sleeve 18. Upon the completion of the filling action, cam 20 again lowers until sealing ring 17 seals the discharge sleeve 18.

The liquid inlet passage 14 is arranged in the piston extension 2 on a lateral side toward the axis of rotation of the filling machine. A tubular inlet piece having an outer portion of increased diameter is inserted into passage 14, the inner wall of the extended outer portion supporting an elastic sealing ring 24. This elastic sealing ring 24 supports in turn the end portion of a rigid liquid feeding pipe 25 in such a manner that the latter is in sealing contact with the ring even when subject to rotation during the relatively short stroke of piston parts 2 and 3 and moves without touching the inner wall of the extended tubular portion 23. The rigid pipe 25 spans a longer distance such as, for instance, more than 1 meter, and leads to a connection on a liquid storing tank which is arranged, for example, in the center of rotation of the filling machine. The elastic coupling to the outlet connection of the tank at the other end of rigid pipe 25 corresponds to the connection 23, 24 and 25 to the piston extension 2. Accordingly, the pipe 25 is supported only at its two ends by respective sealing rings 24. As mentioned above, due to relatively small vertical displacement of piston parts 2 and 3 a relatively small change of angular position of the relatively long pipe 25 takes place and the angular changes can be intercepted by the elastic sealing rings.

Return pipe 26 passes through an axial bore in piston parts 2 and 3 and projects upwardly through cylindrical recess 4 into air return chamber 6. An intermediate portion of air return pipe 26 is in sliding contact with a sealing ring 45 arranged in the bore portion in piston 3. A similar axial boring of larger diameter is also provided in valve member 16 so that a return pipe 26 passes through this increased boring without contacting the valve member. The aforementioned upper sealing ring 28 prevents the liquid filled into bottle 9 from leaking through the upper part of valve chamber 15 into the boring 27. Since by this means no overflow of the liquid can take place when valve member 16 is closed, no additional seal in boring 27 of valve member 16 is necessary.

The upper portion of air return pipe 26 projects as mentioned above into air return chamber 6 provided in the upper part of cylindrical head 1 and in the range of this chamber the pipe 26 is provided with a toothed rack 29. The rack is in mesh with a pinion 30 which is supported for rotation in a recess in the inner wall of the air return chamber 6. The shaft of pinion 30 is rotatably supported in the walls of head 1 whereby the projecting end of the shaft (not illustrated) is connected to lever 31 which at its free end supports a cam follower 32.

A setting screw 34 is provided in a threaded hole in a projection 33 extending from cylindrical head 1 opposite the pinion lever 31 and forms a stop for this lever. Cam follower 32 during the rotation of the filling machine comes into engagement with a non-illustrated sinking cam as well as with a lifting cam 35 and the resulting reciprocating movement is transmitted through the rack and pinion transmission 29 and 30 to the air return pipe 26.

In the filling position of the filling valve as illustrated in the drawing the air return pipe 26 is in its lowermost position in which its lower end portion is introduced into the bottle to determine the filling level. This lowermost position of the pipe 26 corresponds to the lifted position of the control lever 31 for the pinion 30. Upon completion of the filling process and prior to the replacement of the bottle 9 control lever 31 is lowered by means of the aforementioned lowering cam and pipe 26 is raised above the bottom surface 13 of the piston extension 2. As it has been already described above, the piston parts 2 and 3 have to be raised a small distance above the bottle rim 12 so as to completely remove the bottle from the conical recess 7.

In the illustrated filling position of the filling valve the vertical position of the air return pipe 26 within bottle 9 has to be set very accurately in order to insure that its bottom edge projecting into the interior of bottle 9 be always accurately positioned at the desired filling level. In the illustrated exemplary embodiment, filling position of the air return pipe 26 can be very accurately adjusted by the adjustable stop 34 of the pinion lever 31. This stop member 34 in the form of an adjustment screw enables compensation for all inaccuracies of the filling machine or for the tolerances occurring in the filling valve proper. In a preferred embodiment, a lifting cam 35 is spring loaded to avoid any damage and corresponding springs can be provided also between the lever 31 and the cam follower 32.

In another non-illustrated embodiment of this invention the vertical position of the lifting cam 35 is adjustable while the adjustment screw is eliminated. The exact filling position of the air return pipe 26 is adjusted by means of this lifting cam. The advantage of the latter embodiment is the fact that during rotation of the filling machine all filling valves are controlled by the same lifting cam 35 to insure identical filling position of their return pipes. This vertically adjustable lifting cam 35 is preferable in the case when batches of different containers requiring different filling levels are to be rapidly processed in the same filling machine.

The top of the cylindrical head 1 is provided with connection 44 for pressurized gas which is in alignment with the axial boring for return pipe 26 and is further provided with a pressure valve. The valve consists of a valve chamber 38 having at its bottom a downwardly tapering conical seat 36 communicating with the air return chamber 6 through a short axial boring portion 39. The axial boring portion 39 is normally closed by valve ball 37 of a plastic material, for example. Ball 37 is freely movable in valve chamber 38 and rests on its conical seat 36 with a very small force corresponding to its own weight.

The top end of air return pipe 36 is provided with an axial projection 40 below which apertures 41 insure communication of the interior of pipe 26 with air return chamber 6. The outer diameter of the top projection 40 is smaller than the inner diameter of boring portion 39 and the length of the projection 40 is sufficient to lift the valve ball when pipe 26 is raised during the exchange of the container.

Valve ball 37 in connecting piece 44 is constantly subject to the pressure of pressurized gas and normally is sealingly pressed against its seat 36. At the beginning of the filling process the pressure valve 36 and 37 has to be momentarily open in order to pressurize the air return chamber 6 and the inner space of bottle 9 communicating with the latter. For this purpose control lever 31 for lifting the air return pipe 26 is momentarily actuated by an additional lowering cam (not shown) to impart an additional lift to pipe 26 during which the projection 40 at the top end of pipe 26 raises the valve ball 37 and opens the passage through-boring portion 39.

During this instant opening of the unidirectional valve 36 and 37 the pressurized gas from conduit 44 enters the interior of bottle 9 and the pressure relief valve 36 and 37 can be closed again by lowering the pipe 26. Subsequently, the filling operation takes place during which the level of liquid charged into bottle 9 keeps raising and through air return pipe 26 air from the interior of the bottle is expelled into the air return chamber 6. The increased pressure in chamber 6 resulting from the returning air raises again the light valve ball 37 and the excess air is compelled back into the pressure gas conduit 44. In the event that bottle 9 breaks during the filling process, the ball valve 37 automatically and without delay seals its valve seat 36.

In addition, a pressure relief valve 43 in a pressure relief conduit 42 is provided at the top of air return chamber 6. The pressure relief valve 43 is normally closed by the action of a spring as well as by the pressure of pressurized gas in chamber 6 and is operated by an additional non-illustrated cam to release pressure from air return chamber 6. The pressure relieving operation takes place in a conventional manner at the end of the filling operation. This pressure relieving step serves for equalizing pressure in the residual free space in the charged bottle 9 and in the interconnected gas spaces in the filling valve with the pressure of outer atmosphere so that the filled liquid in the bottle be prevented from foaming when the filling valve is removed. The pressure release takes place gradually by a suitable activation of the pressure relieving valve 43 and by forming conduit 42 as a throttling conduit. Due to the arrangement the pressure relief conduit at an elevated point in the filling valve insures that no liquid sprayed on the inner walls of the filling valve is taken along by the streaming gas. Nonetheless, it is still necessary to insure that during the pressure relieving operation at the end of the filling process the air return pipe 26 is empty and free of any liquid. This requirement could be met by a valve member at the lower end of the air return pipe 26. With the shown embodiment not having such a valve member, care must be taken however that upon completion of the filling process the liquid column remaining in the air return pipe 26 be discharged prior to the initiation of the pressure relieving process. This residual liquid column is discharged automatically by lifting pipe 26 before the pressure relieving step is initiated. Due to the fact that the spaces in the filling valve communicating with the ends of the air return pipe are sealed with respect to each other during the lifting movement of the pipe, by lifting the pipe 26 gas is pushed through the pipe pushing the fluid column downwardly.

In a modification of the illustrated embodiment the lower part 2 of the filling valve may be designed integral with the cylinder, the piston then being provided at the head 1. Nonetheless, the condition that the cylinder piston unit is arranged above the pressure controlling valve 15 and 16 is to be maintained.

As can be seen from the drawing, the arrangement of the filling valve according to this invention in which all liquid conducting components are arranged in the lower part 2 of the valve presents from the viewpoint of fluid technology optimum design possibilities. For example, the part of valve chamber 15 below the upper sealing ring 28 of the valve member 16 can have an arbitrary size and can be designed as a spin generating spiral inlet chamber.

Also the lifting and lowering mechanism for the air return pipe 26 can be designed in a different manner as illustrated. For instance, the air return pipe can be lifted by means of a fork lever and the like. The air return pipe lifting mechanism can be arranged also in the lower part 2 of the filling valve if desired. The illustrated preferred embodiment in which the air return pipe driving mechanism is arranged above the liquid controlling chamber is more advantageous since it will not interfere with the operation of the liquid valve arrangement.

By a suitable modification of the liquid discharging parts 7, 8 and 18 the filling valve of this invention can be employed also for filling cans. For this purpose the valve portion in the region of the sealing element 8, can be made exchangeable, for example. In this case it is possible to fill with the same filling valve the bottles and alternatively, the cans. The adjustment of the filling level in the container by adjusting the insertion of return pipe 26 into the latter is considerably facilitated by the above-described structure of the filling valve.

It will be understood that each of the elements described above, or two or more together, may also find a useful application in other types of constructions differing from the types described above.

While the invention has been illustrated and described as embodied in a filling valve arrangement for use with rotating filling machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be prosecuted by Letters Patent is set forth in the appended claims.

I claim:

1. A filling valve for filling a gas-pressurized liquid into containers, comprising at least one cylinder-piston unit including at least one stationary head part and at least one vertically reciprocable lower part, one of said parts having a cylinder chamber adapted to receive gas under pressure and the other of said parts having a piston portion slidable in said cylinder chamber and having a crosssectional area larger than that bounded by a rim surrounding the inlet of a container to be filled said lower part having a valve chamber and an opening to receive a container to be filled, a liquid-controlling valve disposed in said valve chamber and movable with said lower part; a liquid inlet associated with said valve chamber; a liquid outlet disposed between said valve chamber and said opening to receive a container; a sealing element arranged in said opening so as to be in contact with the rim of the container to be filled, said lower part being moved into a sealing position in engagement with the container for filling the same upon downward vertical movement of said lower part relative to said head part so that a filled container may be replaced with an empty container by lateral movement thereof and without raising or lowering of the containers; and passage means connecting said cylinder chamber and opening in permanently open communication with one another, so that identical gas pressure prevails in said cylinder chamber and opening and hence also in a container communicating with said opening, whereby the container is internally supported by the gas pressure.

2. The filling valve as defined in claim 1, wherein a liquid inlet conduit is arranged laterally at said lower part communicating with said liquid inlet, the inner wall of said lateral inlet conduit including a sealing ring of elastic material for supporting an end portion of a rigid pipe leading to a liquid storing tank.

3. The filling valve as defined in claim 1, wherein said head and lower parts are provided with axial borings respectively in alignment with said valve chamber, said passage means including an air return pipe slidably supported in said head orr lower parts; and additional drive means for imparting reciprocating movement to said air return pipe to lift the same during the exchange of said containers.

4. The filling valve as defined in claim 3, wherein said additional drive means engages said return pipe above said liquid controlling valve.

5. The filling valve as defined in claim 4, wherein said additional drive means is a rack and pinion drive, the rack being secured to the upper portion of said air return pipe.

6. The filling valve as defined in claim 4, wherein said additional drive means are supported by said head part.

7. The filling valve as defined in claim 3, wherein the upper end of said return air pipe is positioned in a return air chamber of the head part during the filling.

8. The filling valve as defined in claim 7, wherein slidable sealing means engage the outside of said return air pipe for sealing the return air chamber with respect to said lower part.

9. The filling valve as defined in claim 8, further including a pressure relief valve communicating with said return air chamber.

10. A filling valve for filling a gas-pressurized liquid into containers, comprising a cylinder-piston unit including a stationary head part having a cylinder chamber adapted to receive gas under pressure and a lower part adapted for a vertical reciprocating movement with respect to said stationary head part, said lower part having a piston portion slidable in said cylinder chamber, an opening to receive a container to be filled, and a valve chamber; a liquid-controlling valve disposed in said valve chamber and movable with said lower part; a liquid inlet associated with said valve chamber; a liquid outlet disposed between said valve chamber and said opening to receive a container; a sealing element arranged in said opening so as to be in contact with a rim of the container when the container is filled, said lower part being moved into a sealing position in engagement with the container for filling the same upon downward vertical movement of said lower part relative to said head part so that a filled container may be replaced with an empty container by lateral movement thereof and without raising or lowering of the containers; and passage means connecting said cylinder chamber and opening in permanently open communication with one another, so that identical gas pressure prevails in said cylinder chamber and opening and hence also in a container communicating with said opening, whereby the container is internally supported by the gas pressure.

* * * * *